United States Patent [19]

Besha

[11] 4,167,358

[45] Sep. 11, 1979

[54] OPEN-CHANNEL FLOW CONTROL SYSTEM

[76] Inventor: James A. Besha, Box 147C, Sickle Hill Rd., Berne, N.Y. 12023

[21] Appl. No.: 839,173

[22] Filed: Oct. 4, 1977

[51] Int. Cl.[2] ..... E02B 7/00

[52] U.S. Cl. ..... 405/87; 405/115

[58] Field of Search ..... 61/27, 29, 30; 52/2; 61/22; 137/236

[56] References Cited

U.S. PATENT DOCUMENTS

| | | | |
|---|---|---|---|
| 2,327,615 | 8/1943 | Ankarlo | 138/94 |
| 2,676,609 | 4/1954 | Pfarrer | 137/375 |
| 2,753,876 | 7/1956 | Kurt | 134/167 |
| 3,010,692 | 11/1961 | Jentoft | 251/61 |
| 3,126,029 | 3/1964 | Englesson | 137/525.3 |
| 3,173,269 | 3/1965 | Imbertson | 61/27 X |
| 3,320,750 | 5/1967 | Haise et al. | 61/12 |
| 3,550,847 | 12/1970 | Scott | 235/201 |
| 3,834,167 | 9/1974 | Tabor | 61/27 X |
| 3,928,980 | 12/1975 | Ganzinotti | 61/30 X |
| 3,974,655 | 8/1976 | Halpern et al. | 61/30 |
| 4,103,496 | 8/1978 | Colamussi et al. | 61/27 |

FOREIGN PATENT DOCUMENTS

| | | | |
|---|---|---|---|
| 2344678 | 3/1974 | Fed. Rep. of Germany | 61/30 |

OTHER PUBLICATIONS

Low-Pressure Air-Testing Equipment for Sewer Pipe, N.B. Products, Inc., Bulletin AT575 (1975).

*Primary Examiner*—Thomas F. Callaghan
*Assistant Examiner*—David H. Corbin
*Attorney, Agent, or Firm*—Finnegan, Henderson, Farabow & Garrett

[57] ABSTRACT

A flow control system for selectively restricting or blocking fluid flow in an open channel or culvert. The system includes a normally collapsed inflatable bladder secured in the channel. When collapsed, the bladder and its securing structure presents virtually no obstruction to fluid flow in the channel. The bladder is selectively inflatable by delivering an inflating medium such as a pressurized gas (air) or a liquid thereto, and, when inflated, provides a controlled obstruction to fluid flow in the channel. The system includes means controlling delivery of the inflating medium to the bladder and also provides for selective and positive withdrawal of the inflating medium for deflation of the bladder. The bladder is sized and shaped according to the contour of the channel for maximum efficiency in controlling fluid flow in the open channel.

23 Claims, 17 Drawing Figures

FIG. 5
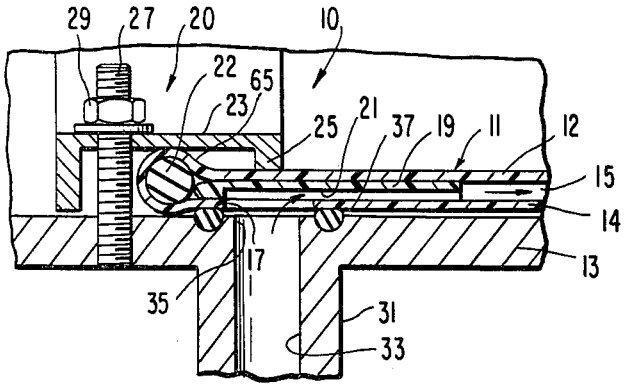
FIG. 6
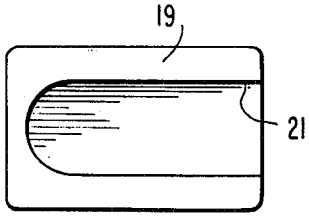
FIG. 7
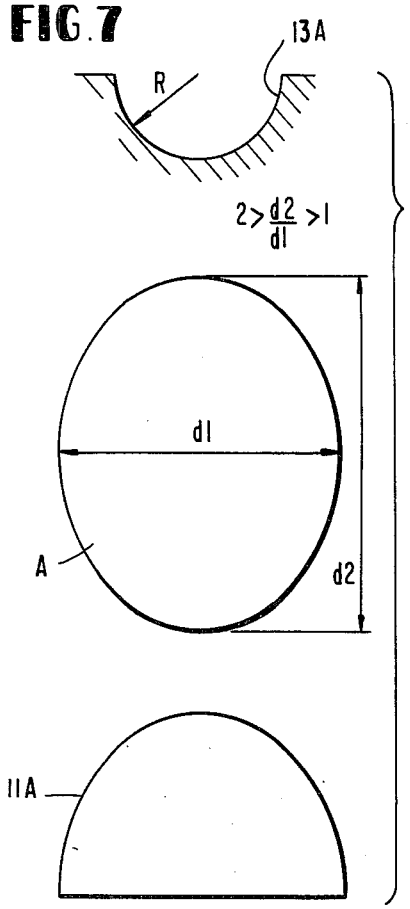
FIG. 8
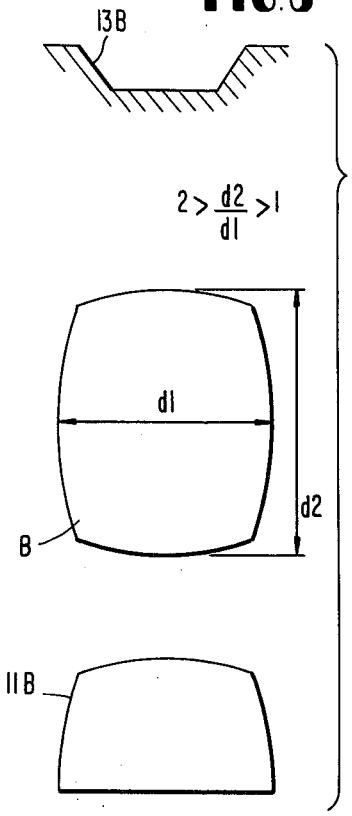
FIG. 9
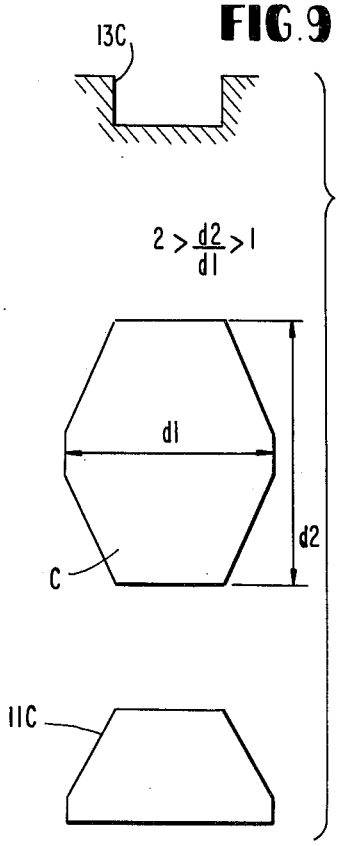
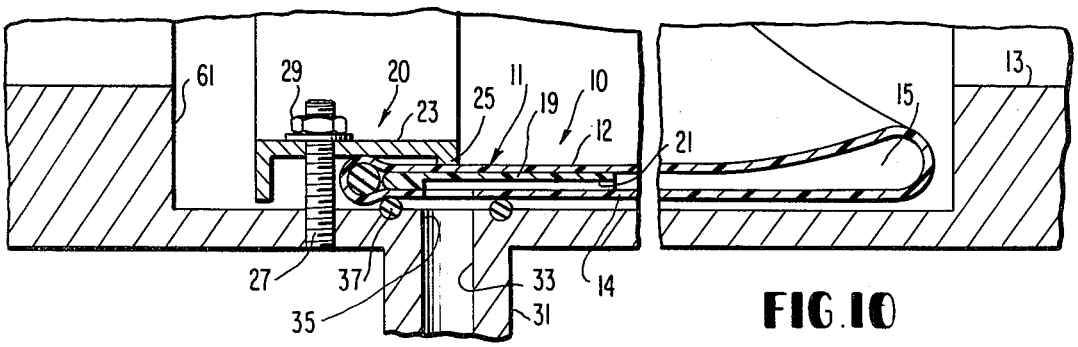
FIG. 10

OPEN-CHANNEL FLOW CONTROL SYSTEM

The present invention relates to fluid flow control systems, and particularly to an improved system for controlling fluid flow in an open channel or culvert. The system is constructed so that when inactive, it provides little or no obstruction to fluid flow in the open channel, but when desired, it can be quickly and easily activated to dam up the channel and block fluid flow therein. The system is constructed so that its parts will not freeze up or become jammed or otherwise inhibited in operation by dirt, silt, or other contamination. Furthermore, the system, when inactive, presents no obstruction to passage of solid particles so that logs, stones, etc. cannot accumulate and cause the system to malfunction.

The system is constructed for positive activation for blocking fluid flow, and positive de-activation for allowing free fluid passage, and can include an alarm for indicating system failure.

Advantageously, the system is constructed with a minimum of moving parts which greatly enhances its efficiency and reliability, and which contributes to its overall low cost.

Fluid flow control systems of the character described are used to control, for example, the water level in reservoirs. In these systems, water normally flows in an open channel and bypasses the reservoirs. When it is desired to divert flow to one of the reservoirs, flow is dammed or blocked at a selected point. This causes water to back up behind the dam and to overflow into the reservoir. Once the desired water level in the reservoir is achieved, the dam or blockage is removed and normal flow resumes in the channel.

Typically, fluid flow control in open channels of the character described is achieved by a motor driven slide gate mechanism. In these systems, the slide gate is retracted during normal flow in the channel, but is slidably lowered into the channel to dam or block fluid flow therein.

It will be appreciated, however, that slide gate mechanisms face a number of problems including ice formation or dirt and sediment accumulation on the moving parts which can jam or otherwise inhibit proper operation of these parts.

Furthermore, large solid objects such as logs, stones, and the like appear in these open channels and can accumulate at the gate so that the gate cannot be properly lowered. These problems are particularly likely to occur when there are long periods between gate operations. In the reservoir water lever control systems referred to above, the time period between gate operations can be anywhere from a few hours to several months.

Accordingly, the present invention employs a mechanism which, when inactive, provides virtually no obstruction to fluid flow in the open channel so that foreign objects cannot accumulate and jam the operation of the mechanism.

Further in accordance with the invention, the mechanism is selectively operable to an active position to dam or block fluid flow in the channel regardless of whether ice may have formed on the mechanism.

The invention is designed for positive activation and deactivation, and can include a signal device indicating failure.

The invention includes a relatively simple mechanism having a minimum of exposed and moving parts.

Additional objects and advantages of the invention will be set forth in part in the description which follows and in part will be obvious from the description, or may be learned by practice of the invention. The objects and advantages of the invention may be realized and obtained by the instrumentalities and combinations particularly pointed out in the appended claims.

To achieve the foregoing objects and in accordance with the purpose of the invention, as embodied and broadly described herein, the open channel flow control system of this invention comprises a flexible bladder contoured so that when collapsed, it conforms generally to the bottom surface of the open channel, fastening means holding a portion of the bladder against the bottom of the channel, the bladder being free to inflate upwardly and contoured so that when inflated, it substantially fills the channel, the fastening means and the bladder providing minimal obstruction to free fluid flow in the channel, passage means connected to the bladder for delivering an inflating medium to the interior of the bladder and operable to inflate the bladder, whereby the inflated bladder blocks the flow of fluid in the open channel.

Preferably, means is provided to positively withdraw the inflating medium from the bladder, thereby causing the bladder to collapse, whereby normal fluid flow resumes in the open channel.

Further, the flow control system includes regulation means which is selectively operable to inflate and collapse the bladder.

The invention consists of the novel parts, construction, arrangements, combinations and improvements shown and described. The accompanying drawings which are incorporated in and constitute a part of the specification illustrate preferred embodiments of the invention, and together with the description, serve to explain the principles of the invention.

OF THE DRAWINGS

FIG. 5 is a longitudinal sectional view showing the preferred form of dam assembly constructed according to the present invention;

FIG. 6 is a plan view of an insert used in the construction of FIG. 5;

FIGS. 7-9 illustrate typical channel shapes and associated bladders used therewith;

FIG. 10 is a view similar to FIG. 5 and showing a modified form of channel;

Figure 1:
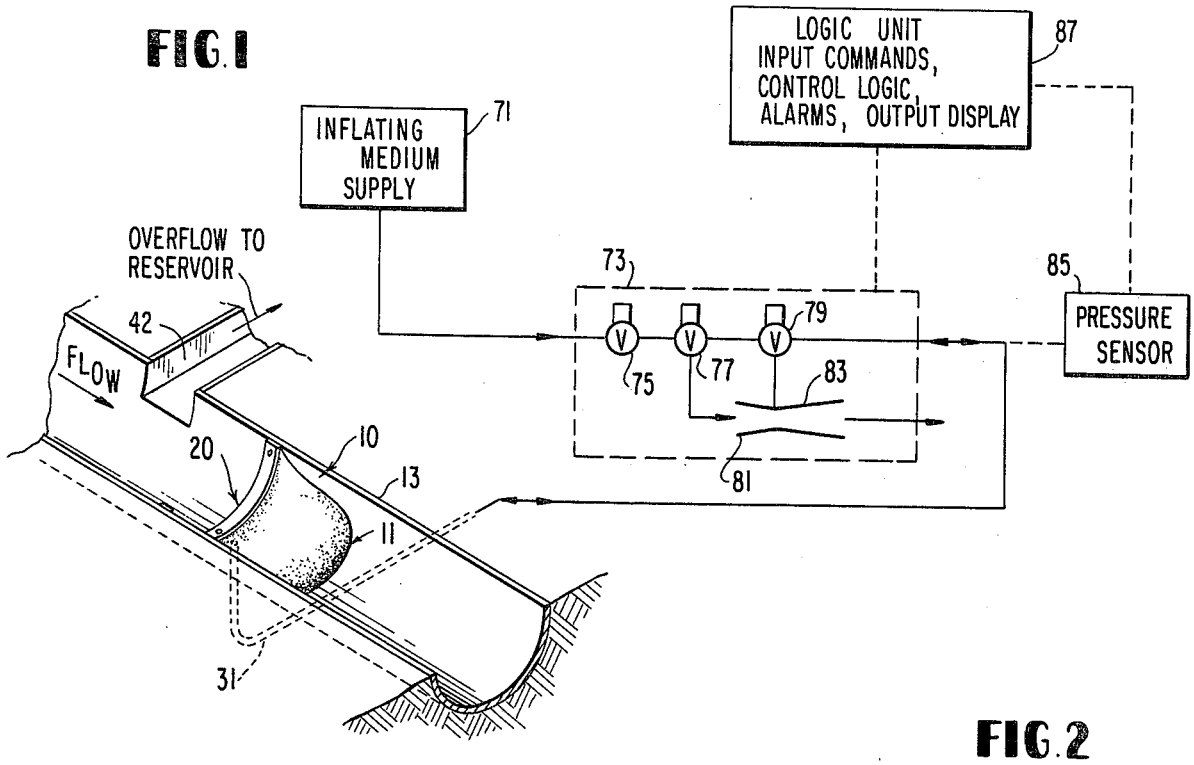
FIG. 1 is a view, partially schematic, illustrating a flow control system embodying the present invention.
Figure 2:
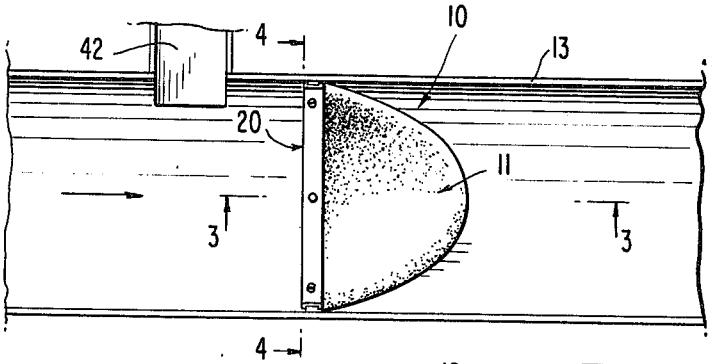
FIG. 2 is an enlarged plan view showing a typical channel and a preferred form of dam assembly used therewith.

Referring now to FIGS. 1, 2 and 5, an open-channel flow control system constructed in accordance with the present invention is seen to include a dam assembly 10 including a bladder generally indicated at 11, positioned in an open channel or culvert 13. The bladder 11 is constructed of an inflatable, flexible material and has upper and lower plies 12, 14 defining a chamber 15 (see FIG. 5). The lower ply 14 has an aperture 17 for a purpose to be described.

In accordance with the invention, the bladder 11 has a rigid insert 19 positioned therein. The insert 19 is preferably contoured complimentary to the surface of channel 13, and has a recess 21 formed in its underside and extending to one end thereof. Preferably, the insert 19 is suitably fixed within the bladder 11 with the recess 21 aligned with the aperture 17, as shown in FIG. 5. In addition, the bladder 11 has a transverse bar 22 enclosed therein forming a bulb 65. Bar 22 may be constructed of any suitable material such as, for example, neoprene.

Retainer means 20 is provided to secure the bladder 11 in place within the open channel 13. This retainer means includes a clamp 23 shaped to the contour of the channel 13 and which fits against the bottom surface thereof. The clamp 23 has a front lip 25 positioned to bear against the bladder 11 and insert 19 forwardly of bulb 65 to hold this end of the bladder securely against the surface of channel 13. Suitable means, such as bolts 27 and nuts 29, are provided to removably secure clamp 23 in place in the channel 13. The insert 19 prevents bladder plies 12, 14 from being pressed against one another by clamp 23 and insures that aperture 17 is open. Bulb 65 helps prevent the bladder 11 from pulling out of the clamp 23.

Means is provided to deliver an inflating medium to the bladder chamber 15 to inflate the bladder 11. This means includes a conduit 31 defining a passageway 33 terminating in an opening 35 in the bottom of channel 13. Opening 35 is aligned with aperture 17 in bladder 11 and with the recess 21 in insert 19. The passageway 33 is connected to a source of inflating medium, such as pressurized air as will be described. A suitable seal 37 is positioned between channel 13 and bladder 11 surrounding aligned opening 35 and aperture 17. It will be appreciated that when the clamp 23 is drawn tightly against the bladder 11, insert 19 and bulb 65 press bladder ply 14 against seal 37 to prevent the loss of inflating medium.

In the position of the parts shown in FIGS. 1, 2, 3A, 4A, and 5, the dam assembly 10 is inactive. The clamp 13 as well as the bladder 11 and insert 19 are confined against the bottom of channel 13 so that the parts provide virtually no obstruction to the flow of fluid in the channel 13. Thus, this fluid as well as foreign objects contained therein such as logs, rocks, silt, etc., can flow freely in the open channel 13 and will not be stopped nor accumulate at the dam assembly 10.

While the dam assembly 10 is inactive, flow of fluid in the channel 13 is unrestricted. The level of fluid flowing unrestricted in the channel 13 is illustrated at 40 in FIG. 3A, and is somewhat below the level of a transverse channel 42. This transverse channel 42 may be another fluid flow channel, or, it may connect channel 13 to, for example, a reservoir. In any event, at this time, no fluid from channel 13 flows in transverse channel 42.

Figure 3A:
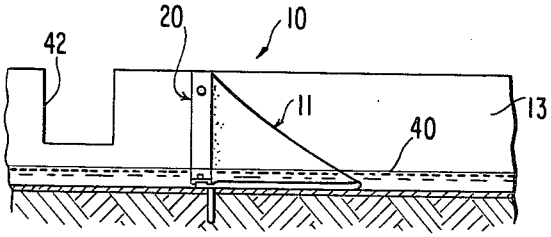
FIG. 3A is a sectional view taken along the line 3—3 of FIG. 2 and showing the dam assembly in its collapsed or inactive state; or inactive state.
Figure 3B:
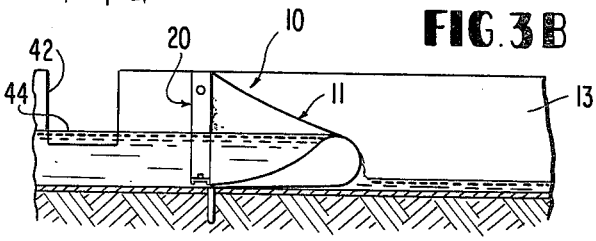
FIG. 3B is a view similar to FIG. 3A and showing the dam assembly in its active or expanded condition.
Figure 4A:
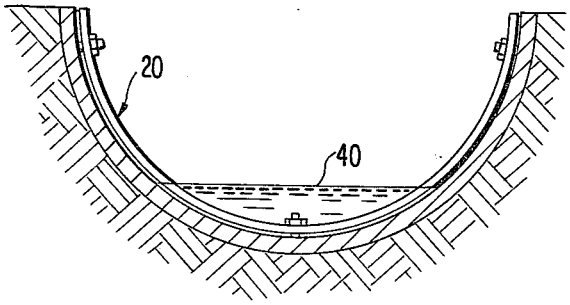
FIG. 4A is an enlarged end view of the structure of FIG. 3A.
Figure 4B:
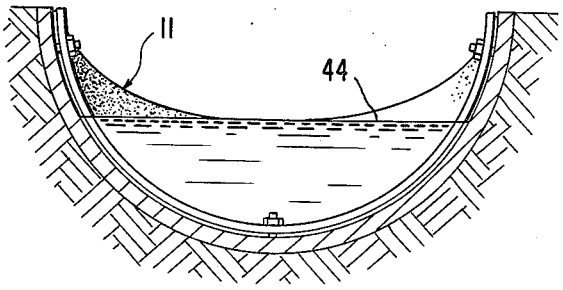
FIG. 4B is an enlarged end view of the structure of FIG. 3B.

When it is desired to divert some of the fluid in channel 13 to the transverse channel 42, the dam assembly 10 is actuated to restrain or block the flow of fluid in the channel 13. To achieve this, the inflating medium is delivered through the passageway 33 and enters the bladder 11 by way of opening 35, aperture 17, and recess 21. This causes the bladder 11 to inflate by expansion of chamber 15 so that the bladder 11 partially or completely fills the channel 13; as shown in FIGS. 3B and 4B. This causes fluid in the channel 13 to back up behind the dam assembly 10 and the level of fluid in the channel 13 to rise to the level indicated at 44 in FIG. 3B. Since level 44 is above the level of transverse channel 42, fluid in channel 13 flows in transverse channel 42 and to the reservoir if one is connected to channel 42.

When sufficient fluid in channel 13 has been diverted to the reservoir, the dam assembly 10 is deactivated. This causes normal flow to resume in channel 13 and the level of fluid in the channel to drop below the level of transverse channel 42. Preferably, this is achieved by positively withdrawing the inflating medium from the bladder 11 through the passageway 33. The bladder 11 then collapses and again reumes a position flat against the bottom of the open channel 13.

In accordance with one feature of the invention, the recess 21 in insert 19 allows positive withdrawal of the inflating medium from the bladder 11 and prevents plies 13, 14 from being drawn together during bladder deflation and from blocking medium withdrawal.

In accordance with another feature of the invention, bladder 11 is purposely shaped so that when collapsed, it lays against the surface of channel 13, and when expanded, it can substantially fill the channel 13. FIGS. 7–9 show typical channel shapes and contoured bladders to be used therewith. In addition, FIGS. 7–9 illustrate the shape of original material pieces from which these bladders are formed.

Channel 13A, shown in FIG. 7, is semicircular in cross-section. A preferred bladder for use with channel 13A is shown at 11A. Bladder 11A is conveniently formed from an elliptical shaped member A, also shown in FIG. 7, and which is folded back on itself about its minor axis and sealed around its edges. Preferably, this member A has a minor diameter d1 substantially equal to:

$$\pi R$$

where "R" is equal to the radius of the channel 13A as shown in FIG. 7. Preferably, the ratio of the major diameter d2 of member A to the minor diameter d1 is expressed as follows:

$$2 > d2/d1 > 1$$

In addition to the semicircular configuration illustrated at 13A in FIG. 7, a typical channel may have a trapezoidal cross-section as shown at 13B in FIG. 8, or a rectangular cross-section as shown at 13C in FIG. 9.

For the trapezoidal channel 13B, bladder 11B is formed from a sheet of material 11B shaped as shown in FIG. 8. Sheet B has a minor diameter d1 substantially equal to the perimeter of channel 13B, and a ratio of major diameter d2 to d1 expressed as follows:

$$1.5 > d2/d1 > 1$$

For the rectangular channel 13C, an octagonal sheet of material C is used having a minor diameter d1 equal to the perimeter of channel 13C, and a ratio of major diameter d2 to d1 expressed as follows:

$$2>d2/d1>1$$

The illustrated bladders can be constructed of any suitable material which is flexible, and can retain the inflating medium used, and which is sufficiently resistant to wear, tearing, bursting under pressure, and other physical factors in the environment in which it is to be used. Obviously, a number of materials will satisfy these criteria for many uses, one such suitable material being a fabric reinforced elastomer. Suitable elastomers include neoprene, natural rubber, chlorosulfanated polyethylene, polyethylene, polyurethane coated scrim, and polyvinyl chloride. Fabric reinforcement for these elastomers can be provided by metallic fabrics, synthetics such as rayon or nylon, or other fibers.

The material selected is cut to the desired shape shown in FIGS. 7–9, folded back on itself along its minor diameter, and it seams sealed together, for example, using high frequency induction heat sealing or solvent welding to form the enclosed chamber 15.

Other forms of retainer means and dam assemblies may be substituted for that illustrated and described above in FIG. 35. For example, as shown in FIG. 10, the channel 13 may include a recess 61 in which substantially the same dam assembly 10 as illustrated in FIG. 5 is mounted. By disposing the dam assembly 10 in recess 61, the dam assembly presents no obstruction to passage of fluid or solid objects through channel 13.

Figure 11:
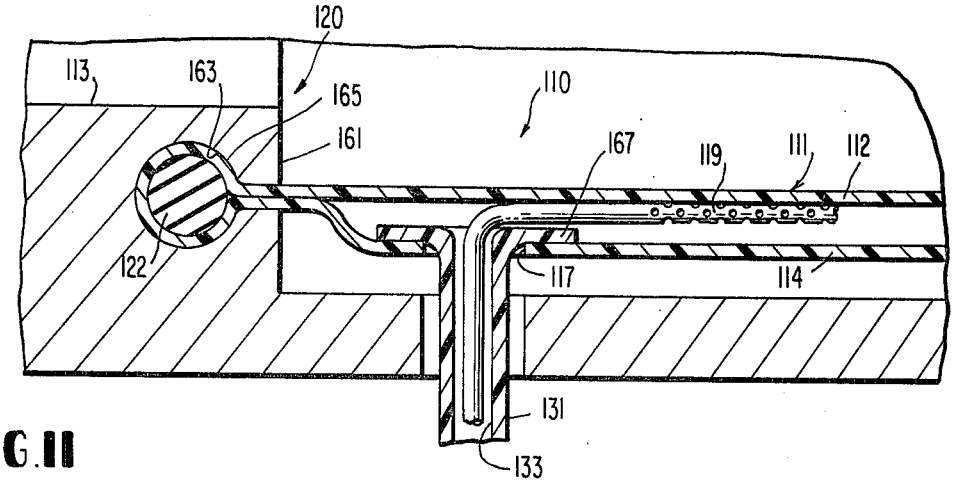
FIG. 11 is a view similar to FIG. 10 and showing a modified form of dam assembly and retainer means.

FIG. 11 illustrates a channel 113 having a recess 161 in which a modified dam assembly 110 is mounted. A retaining means 120 includes a secondary recess 163 cast in place or machined in the wall of recess 161 and receiving a mating bulb 165 formed by rod 122 and bladder 111. Inflating medium is delivered to bladder 111 through passageway 133 formed in conduit 131, the latter having a nipple 167 sealingly bonded to bladder 111 at inlet 117.

In the embodiment of FIG. 11, a perforated tube 119 is carried by conduit 131 and extends between the bladder plies 112, 114. Tube 119 serves the purpose of preventing the bladder plies 112, 114 from being drawn together during deflation of the bladder 111 and facilitates positive withdrawal of the inflating medium therefrom.

Figure 12:
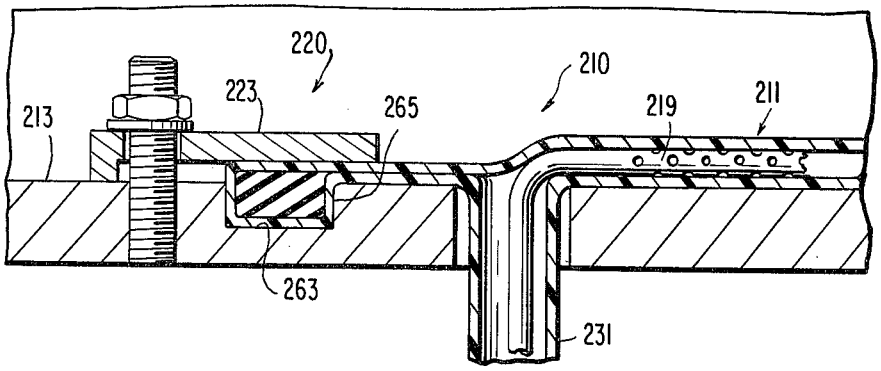
FIG. 12 is a view similar to FIG. 5 and showing a modified form of dam assembly and retainer means.
Figure 13:
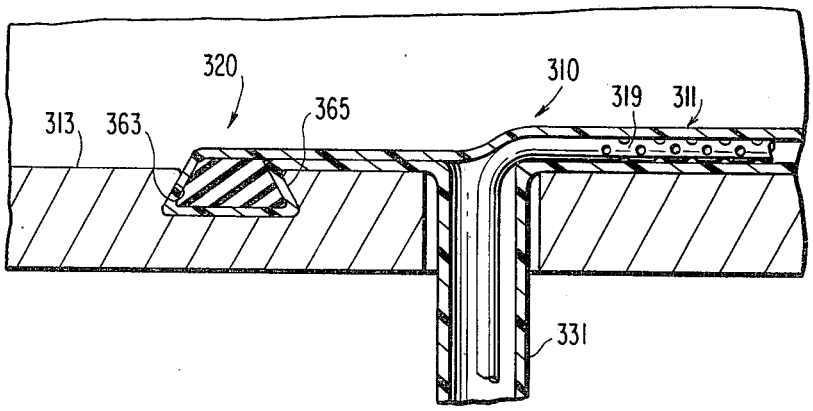
FIG. 13 is a view similar to FIG. 12 and showing a still further modified form of retainer means.

In the embodiments of FIGS. 12 and 13, dam assemblies 210 and 310 include bulbs 265 and 365 positioned in complimentary recesses 263 and 363 in channel 213 and 313, respectively. In FIG. 12, a retainer clamp 223 similar to that of FIGS. 5 and 10 is employed. In FIG. 13, the complimentary shaped bulb 365 and recess 363 retain the dam assembly 310 in place. In FIGS. 12 and 13, the bladders 211, 311 are shown formed integral with fluid medium supply conduits 231, 331, and include perforated tubes 219, 319, respectively, to facilitate positive withdrawal of the inflating medium.

Figure 14:
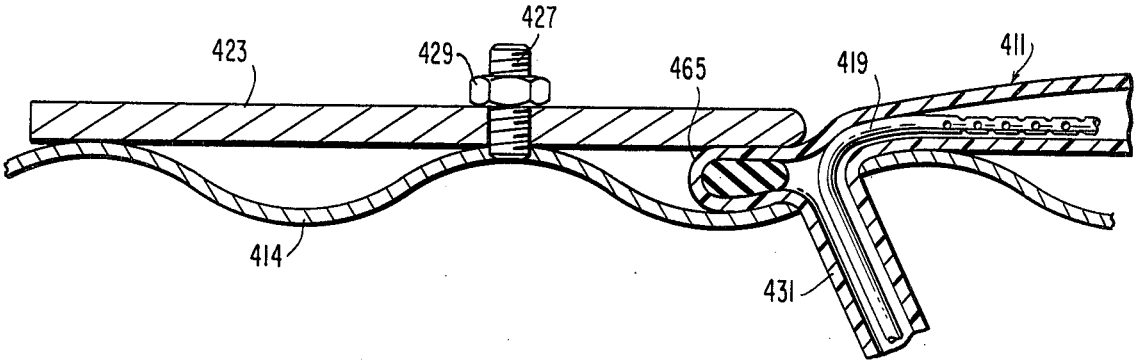
FIG. 14 is a view similar to FIG. 12 and showing a modified form of channel and retainer means.

The embodiment of FIG. 14 shows a channel 414 constructed of corrugated pipe. The dam assembly 410 includes a bladder 411 and a bulb 465, and is retained in place by a clamp 423 secured to the channel 414 by a stud 427 and a nut 429. Conveniently, the bulb 465 is positioned in a valley of the corrugated channel 414, when viewed in longitudinal section, and the retainer clamp connection is made at a peak in the channel 414. A perforated tube 419 is provided in the bladder 411 to facilitate positive withdrawal of the inflating medium from the bladder.

A regulating system for selectively expanding and contracting the bladder 11 in accordance with the present invention is shown in FIG. 1. A supply 71 of inflating medium for example, compressed air, is connected to a transfer module 73 which, in turn, is connected to conduit 31.

Module 73 includes three solenoid operated valves 75, 77, 79. Valve 75 is an on/off valve. Valve 77 is operable to alternately connect gas supply 71 to conduit 31 or to an inlet 81 of an aspirator 83. Valve 79 is operable to alternately connect conduit 31 to supply 71 or to aspirator 83.

A pressure sensor 85 responds to air pressure within the conduit 31 and is constructed to control valve 75 as hereinafter described. A logic unit 87 controls operation of valves 75, 77, 79 in response to appropriate signals.

In use, when it is desired to inflate the bladder 11, logic unit 87 is set so that supply 71 is connected to conduit 31 through valves 75, 77, 79 acting in tandem. The sensor 85 senses the pressure in conduit 31 so that if the proper pressure exists in the conduit 31 after a preselected time of operation, valve 75 is turned off and holds the supplied pressure of inflating medium in the bladder 11. If insufficient pressure exists in conduit 31 at any time after inflation indicating, for example, that the bladder has been punctured, sensor 85 turns valve 75 to off to prevent loss of inflating medium.

When it is desired to deflate the bladder 11, unit 87 is actuated to reverse the position of valves 77, 79 while at the same time turning valve 75 on. Now, pressure from supply 71 flows through valve 75 and through valve 77 to the inlet 81 of aspirator 83. Conduit 31 is now connected by valve 79 to the aspirator 83 so that pressure from bladder 11 is sucked through conduit 31. In the case where compressed gas is the inflating medium, it discharged from aspirator 83 to the atmosphere.

Figure 15:
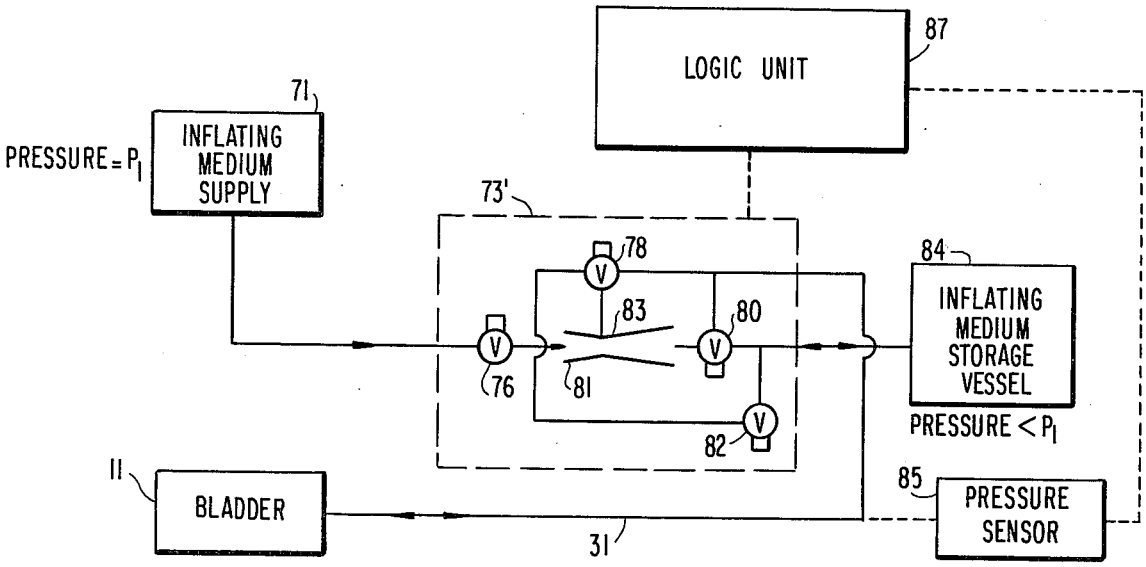
FIG. 15 is a schematic view showing an alternate form of regulation means for inflating and collapsing the bladder.

A modified form of regulating means for selectively inflating and collapsing the bladder 11 in accordance with the present invention is shown in FIG. 15. In this figure, valve 76 is an on/off gas supply valve. Valve 80 is operable to alternately connect the outlet of aspirator 83 to conduit 31, or to a storage vessel 84 for the inflating medium. Valve 78 is operable to alternately connect aspirator 83 to bladder 11 by way of conduit 31, or to the inflating medium storage vessel 84 by way of valve 82.

In use, when it is desired to inflate the bladder 11, logic unit 87 is set so that inflating medium supply 71 is connected to conduit 31 through valve 76, aspirator 83, and valve 80. Simultaneously, valve 82 and valve 78 are operated to permit the passage of inflating medium from the storage vessel 84 to aspirator 83. At this time, inflating medium is drawn from the storage vessel 84 through the aspirator 83 and combines with inflating medium from the primary supply 71 to inflate the bladder 11. This combined action increases the efficiency of the system and allows a substantial reuse of the inflating medium which is sometimes economically important. The pressure sensor 85 acts in a manner similar to that described above for FIG. 1.

When it is desired to collapse the bladder 11, logic unit 87 is actuated to open valve 76 allowing inflating medium through aspirator inlet 81, and valve 80 is positioned to allow inflating medium to flow from the primary supply 71 to storage vessel 84. At this same time, valve 78 allows bladder 11 to discharge inflating medium by way of conduit 31 to aspirator 83, and the inflating medium is drawn through the aspirator and is delivered to the storage vessel 84.

Storage vessel 84 is sized to allow inflating medium storage at a pressure less than the pressure at supply 71. The vessel 84 may be constructed as a flexible gas storage bladder and can use materials similar to those described above for the bladder 11.

It will be appreciated that all of the described dam assemblies can be activated and the corresponding bladders expanded regardless of whether ice had formed on the bladder, or whether solid objects such as logs, rocks, etc. are in the fluid flowing in the channel 13, and that all the described bladders can be collapsed by positive withdrawal of the inflating medium. Furthermore, there are no sliding parts in the dam assemblies to jam as a result of ice formation or dirt accumulation.

It will be apparent to those skilled in the art that various additions, substitutions, modifications, and omissions may be made to the system of this invention without departing from the scope or spirit of the invention.

What is claimed is:

1. A fluid flow control system for use in an open channel having a generally semicircular cross-section, said system comprising a flexible bladder adapted to lie in the bottom of said open channel, said bladder having a substantially semielliptical shape in plan and a linear edge substantially equal in length to the circumference of said semicircular channel and extending transversely thereof, retainer means holding the portion of said bladder along said linear edge against the bottom of said channel and contoured substantially the same as said channel, said bladder having an inlet opening, conduit means associated with said channel and communicating with said bladder inlet opening, regulating means for selectively delivering an inflating medium through said conduit means to said bladder to inflate said bladder, said regulating means being selectively operable to positively withdraw said inflating medium from said bladder to collapse said bladder, said bladder, when inflated, substantially filling the open channel, said bladder being substantially free of folds or creases in both its inflated and collapsed conditions which could inhibit inflation or collapse thereof.

2. A fluid flow control system as defined in claim 1 wherein said bladder includes upper and lower plies of flexible material, an insert in said bladder between said plies, said insert being separate from said bladder and normally holding said plies spaced from one another in the area of said inlet opening.

3. A fluid flow control system as defined in claim 2 wherein said insert is contoured substantially complementary to the channel surface and is at least as wide as the width of said inlet opening, said insert having a longitudinal recess communicating said inlet opening with the end of said bladder remote from said linear edge.

4. A fluid flow control system as defined in claim 2 which further includes resilient seal means positioned between said bladder and said channel surface and surrounding said inlet opening and conduit means, said insert overlaying said resilient seal and holding said seal tightly compressed between said bladder and said channel surface.

5. A fluid flow control system as defined in claim 1 wherein said bladder is constructed from a symmetrical, generally elliptical sheet of material folded along its minor diameter and joined and sealed along mating edges, said minor diameter being substantially equal to the perimeter of said semicircular channel and forming said linear edge, said sheet of material having a major diameter which is between one and two times the length of said minor diameter.

6. A fluid flow control system as defined in claim 1 wherein said bladder is constructed of the material selected from a group consisting of neoprene, natural rubber, chlorosulfanated polyethylene, polyethylene, polyurethane coated scrim, and polyvinyl chloride.

7. A fluid flow control system as defined in claim 1 wherein said bladder includes an enlarged bulb at said one end, said bulb being defined by a member separate from said bladder, said clamp adapted to bear against said bladder downstream of said bulb.

8. A fluid flow control system for use in an open channel having a generally trapezoidal cross-section, said system comprising a flexible bladder adapted to lie in the bottom of said open channel, said bladder having a generally rectangular shape in plan including three convex curved edges, said bladder having a linear edge substantially equal in length to the circumference of said trapezoidal channel and extending transversely thereof, retainer means holding the portion of said bladder along said linear edge against the bottom of said channel and contoured substantially the same as said channel, said bladder having an inlet opening, conduit means associated with said channel and communicated with said bladder inlet opening, regulating means for selectively delivering an inflating medium through said conduit means to said bladder to inflate said bladder, said regulating means being selectively operable to positively withdraw said inflating medium from said bladder to collapse said bladder, said bladder, when inflated, substantially filling the open channel, said bladder being substantially free of folds or creases in both its inflated and collapsed conditions which could inhibit inflation or collapse thereof.

9. A fluid flow control system as defined in claim 8 wherein said bladder includes upper and lower plies of flexible material, an insert in said bladder between said plies, said insert being separate from said bladder and normally holding said plies spaced from one another in the area of said inlet opening.

10. A fluid flow control system as defined in claim 9 wherein said insert is contoured substantially complementary to the channel surface and is at least as wide as the width of said inlet opening, said insert having a longitudinal recess communicating said inlet opening with the end of said bladder remote from said linear edge.

11. A fluid flow control system as defined in claim 9 which further includes resilient seal means positioned between said bladder and said channel surface and surrounding said inlet opening and conduit means, said insert overlaying said resilient seal and holding said seal tightly compressed between said bladder and said channel surface.

12. A fluid flow control system as defined in claim 8 wherein said bladder is constructed of the material selected from a group consisting of neoprene, natural rubber, chlorosulfanated polyethylene, polyethylene, polyurethane coated scrim, and polyvinyl chloride.

13. A fluid flow control system as defined in claim 8 wherein said bladder includes an enlarged bulb at said one end, said bulb being defined by a member separate from said bladder, said clamp adapted to bear against said bladder downstream of said bulb.

14. A fluid flow control system for use in an open channel having a generally rectangular cross-section, said system comprising a flexible bladder adapted to lie in the bottom of said open channel, said bladder having a substantially hexagonal shape in plan and one linear edge substantially equal in length to the circumference of said rectangular channel and extending transversely thereof, retainer means holding the portion of said bladder along said linear edge against the bottom of said channel and contoured substantially the same as said channel, said bladder having an inlet opening, conduit means associated with said channel and communicated with said bladder opening, regulating means for selectively delivering an inflating medium through said conduit to said bladder to inflate said bladder, said regulating means being selectively operable to positively withdraw said inflating medium from said bladder to collapse said bladder, said bladder, when inflated, substantially filling the open channel, said bladder being substantially free of folds or creases in both its inflated and collapsed conditions which could inhibit inflation or collapse thereof.

15. A fluid flow control system as defined in claim 14 wherein said bladder includes upper and lower plies, of flexible material, an insert in said bladder between said plies, said insert being separate from said bladder and normally holding said plies spaced from one another in the area of said inlet opening.

16. A fluid flow control system as defined in claim 15 wherein said insert is contoured substantially complementary to the channel surface and is at least as wide as the width of said inlet opening, said insert having a longitudinal recess communicating said inlet opening with the end of said bladder remote from said linear edge.

17. A fluid flow control system as defined in claim 15 which further includes resilient seal means positioned between said bladder and said channel surface and surrounding said inlet opening and conduit means, said insert overlaying said resilient seal and holding said seal tightly compressed between said bladder and said channel surface.

18. A fluid flow control system as defined in claim 14 wherein said bladder is constructed of the material selected from a group consisting of neoprene, natural rubber, chlorosulfanated polyethylene, polyethylene, polyurethane coated scrim, and polyvinyl chloride.

19. A fluid flow control system as defined in claim 14 wherein said bladder includes an enlarged bulb at said one end, said ball being defined by a member separate from said bladder, siad clamp adapted to bear against said bladder downstream of said bulb.

20. A fluid flow control system comprising an open channel, a flexible bladder adapted to lie in the bottom of said open channel, retainer means holding one end of said bladder against the bottom of said channel, said bladder having an inlet opening, conduit means communicative with said bladder inlet opening, regulating means for selectively delivering an inflating medium through said conduit to said bladder to inflate said bladder and being selectively operable to positively withdraw said inflating medium from said bladder to collapse said bladder, said regulating means including an inflating medium transfer module connected at one end to a pressurized supply at its other end to said conduit means, valve means in said transfer module selectively operable from a first position where said inflating medium supply is directly connected to said bladder and said supply pressure delivers inflating medium to said bladder, to a second position where said supply pressure produces suction operable to positively withdraw inflating medium from said bladder.

21. A fluid flow control system as defined in claim 20 said transfer module including aspirator means connected to said inflating medium supply when said valve means is in said second position, whereby said inflating medium supply acts on said aspirator means to positively withdraw said inflating medium from said bladder.

22. A fluid flow control system as defined in claim 20 which further includes an inflating medium storage vessel, said valve means, when in said first position, also connecting said storage vessel with said conduit means, whereby inflating medium stored in said storage vessel combines with inflating medium from said supply to inflate said bladder, said valve means, when in said second position, connecting said storage vessel and said conduit means during withdrawal of said inflating medium from said bladder, whereby said inflating medium withdrawn from said bladder is stored in said storage vessel.

23. A fluid flow control system as defined in claim 1 which includes pressure sensing means interconnected with said conduit, and alarm means operable in response to insufficient pressure existing in said conduit means.

* * * * *